US007185645B1

(12) United States Patent
Neumeir et al.

(10) Patent No.: US 7,185,645 B1
(45) Date of Patent: Mar. 6, 2007

(54) COMPRESSED AIR GUN FOR USE BY POLICE AND FIREFIGHTER FOR BREAKING DOORS OPEN

(75) Inventors: Anlon Neumeir, Mering (DE); Reinhard Effenberger, Affing/Anwalting (DE); Christian Ambühl, Elgg (DE)

(73) Assignee: HNE Technologie AG, Augsburg (DE)

( * ) Notice: Subject to any disclaimer, the term of this patent is extended or adjusted under 35 U.S.C. 154(b) by 0 days.

(21) Appl. No.: 11/362,589

(22) Filed: Feb. 24, 2006

(51) Int. Cl.
*F41B 11/00* (2006.01)

(52) U.S. Cl. ..... 124/71; 124/73; 124/74; 124/75; 124/76; 124/77

(58) Field of Classification Search ..... 124/73–77
See application file for complete search history.

(56) References Cited

U.S. PATENT DOCUMENTS 3,382,859 A * 5/1968 Klingman ..... 124/74
5,450,839 A * 9/1995 Nicolaevich et al. ..... 124/73
6,371,028 B2 * 4/2002 Saxby ..... 102/502
6,543,365 B1 * 4/2003 Vasel et al. ..... 102/502

* cited by examiner

*Primary Examiner*—Michael J. Carone
*Assistant Examiner*—Gabriel J. Klein
(74) *Attorney, Agent, or Firm*—Klaus J. Bach

(57) ABSTRACT

In a compressed air gun for use by police and firefighting forces for breaking open doors, including a compressed air cannon with an ammunition ball, wherein the compressed air cannon has a compressed air chamber, a barrel extending from the compressed air chamber and a discharge valve for releasing the pressurized air from the compressed air chamber into the barrel the ammunition ball consists of a hollow plastic ball which is filled with a heavy material providing, upon being shot out of the barrel by the compressed air, an impact force sufficient to break down a door to be opened without rebounding or generating shrapnel that could endanger a person using the gun.

6 Claims, 2 Drawing Sheets

COMPRESSED AIR GUN FOR USE BY POLICE AND FIREFIGHTER FOR BREAKING DOORS OPEN

BACKGROUND OF THE INVENTION

In order for Police or other units such as firefighters to gain access to houses or apartments, it is necessary to be able to rapidly open the access doors. Such rapid opening of housing or apartment doors may be essential for emergency rescue actions.

Presently, under such circumstances, doors are opened by so-called door rams. Such a door ram comprises a heavy metallic ram member with handles attached thereto. For breaking a door open one or several persons hold the ram and slam it forcefully against the door. Depending on the design and the quality or strength of the door, this slamming procedure must be repeated several times before the door is opened.

The breaking open of doors in this conventional way for example during a police raid can be very dangerous because of the time required therefore. A criminal warned by a first unsuccessful ram blow may shoot from behind the door through the door, and injure or even kill a policeman trying to open the door. In addition, the handling of such a heavy mechanical ram for breaking open heavy solid doors also presents a danger for injury to the persons handling the ram.

In particular in connection with a police raid it is extremely important that a door is reliably opened with the first blow. Also in connection with emergency rescue operations such an apparatus is very advantageous as it avoids the loss of time in opening a door.

It is therefore the object of the present invention to provide an apparatus by which even strong and heavy doors can be reliably opened with a single blow and which can be accomplished by a single person.[1]

SUMMARY OF THE INVENTION

In a compressed air gun for use by police and firefighting forces for breaking open doors, including a compressed air cannon with an ammunition ball, wherein the compressed air cannon has a compressed air chamber, a barrel extending from the compressed air chamber and a discharge valve for releasing the compressed air from the compressed air chamber into the barrel, the ammunition ball consists of a hollow plastic ball which is filled with a heavy material providing, upon being shot out of the barrel by the compressed air, an impact force sufficient to break down a door to be opened without rebounding or generating shrapnel that could endanger a person using the gun.

The gun according to the invention consequently comprises a compressed air operated cannon including ammunition consisting of a hollow thin-walled plastic ball filled with a particulate heavy material such as buckshot or cast hard granular material or a combination of epoxy resin and hard granular material. With the granulate-filled hollow plastic ball, a high kinetic energy and a very high impulse can be achieved. When the granulate-filled plastic ball, shot from a distance of 20 cm to 1 m, hits the door, it generates a large impact force by which the door is opened. Upon impact, the plastic ball is destroyed. No dangerous fragments or other dangerous projectiles are formed in the process which could cause injuries to the user of the gun. Since the ball disintegrates upon impact, the chances of injuries to a person behind the door are also very small.

With the apparatus according to the invention, action units can rapidly and efficiently open locked doors and become active. By the sudden opening of the door reliably at the first attempt, the operation of the action units becomes substantially safer and easier. For the user of the compressed air gun with the ammunition described, no danger is involved.

The normal protective wear such as gloves, helmets, protective vests, etc . . . offers sufficient protection. The ammunition in the form of a granulate-filled hollow plastic ball is so designed that possibly reflected particles will not cause injuries.

The apparatus according to the invention can simply be held in a hand. With a maximum weight of 12 to 15 kg and a construction length of not more than 80 to 90 cm, the apparatus can be carried by a single person also in narrow staircase without difficulties.

The compressed air cannon of the apparatus according to the invention however, can also be loaded with different ammunition such as a water-filled hollow plastic ball. Such ammunition is known for other purposes. Such a compressed air cannon which has been called an industry cannon is used for example for the release of slag deposits in the fire chambers of large heating plants. In order to remove the slag deposits in such large installations in which slag deposits cannot be removed from time to time by the service personal by means of mechanical tools via access openings without shutting down the plant such pressurized air cannons are used to shoot water-filled balls onto the walls covered with slag deposits whereby the slag deposits are chipped off.

Although plastic balls filled with granulate, particularly with buckshot—or metal balls or epoxy resin bonded hard cast granulate have been found particularly advantageous in connection with the present invention because of the high impulse generated thereby it is in principle, possible to use a water-filled ball.

Practical experiments on massive wood beams (pine) with a cross-section of 8 cm×12 cm and also on particle boards of 6 cm thickness have shown the efficiency and the penetration force and consequently the usefulness of the apparatus according to the invention and its application for opening doors etc . . .

Below, the invention will be described in greater detail with reference to the accompanying drawings.

DESCRIPTION OF A PARTICULAR EMBODIMENT

Figure 1:
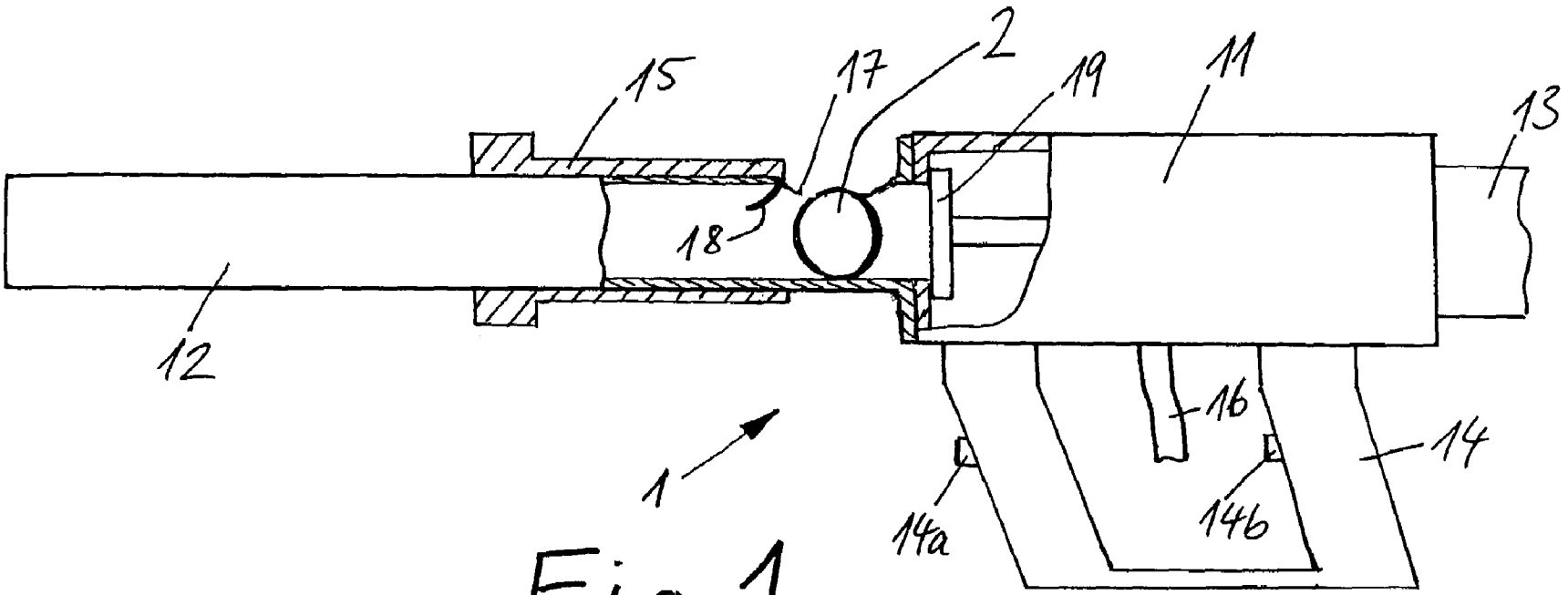
FIG. 1 is in a side view a compressed air gun according to the invention.

The figures show generally a compressed air gun according to the invention without referring to detailed design features, which are well known in the art FIG. 1 shows the pressurized air gun 1 in a side view with cut-away sections. The essential components thereof are a compressed air chamber 11, a barrel 12, a shoulder support 13 an operating handle arrangement 14 and a closure sleeve 15.

The compressed air chamber 11 is in communication with a compressed air bottle 3 via an air pressure hose 16 so that it can be charged with an air pressure of for example 25 bar. The shot barrel 12 extending from the front end of the compressed air chamber 11 includes at its rear end connected to the compressed air chamber 11 a top opening 17 through which an ammunition ball 2 can be placed into the barrel 12. The opening 17 can be closed by a closure sleeve 15 which is axially movably disposed on the barrel 12 and which is shown in FIG. 1 in its open position in which it is moved forwardly. For closing the opening 17, the closure sleeve 15 is moved backwardly over the opening 17 and is locked in the closed position for example by a bayonet locking structure which is not shown. At the rear end of the closure sleeve 15, the closure sleeve 15 may be provided with means such as a spring member 18 for retaining the ammunition ball 2 in the barrel 12 at the end thereof adjacent the compressed air chamber 11. The spring member may be, for example, in the form of a spring steel tongue, which extends into the interior of the barrel 12 by which the ammunition ball 2 placed into the barrel 12 is moved to its rearmost position and is retained therein when the closure sleeve 15 is moved to its closed position. The tongue 18, shown schematically, serves only as an example for a member fulfilling the described function. It is also possible to make the rear-most part of the barrel 12 so narrow that the elastically deformable ball 2 is engaged therein.

For shooting the ammunition ball 2, a schematically shown discharge valve 19, the operating mechanism of which is known and therefore not shown and not described, is suddenly opened so that the pressurized air contained in the pressure chamber 11 is released and the ammunition ball 2 is driven out of the barrel 12 while being strongly accelerated. The backlash of the air gun is accommodated by a shoulder support structure 13 via which the gun is supported by the user.

The apparatus is designed for use with two hands in such a way that, for safety reasons, a shot can be fired only when both hands of a user are at the operating handle arrangement 14. The handle arrangement 14 includes two spaced buttons 14*a* and 14*b*, one at the front and one at a rear part of the handle arrangement 14, which must be both actuated at the same time to fire the gun.

Figure 2:
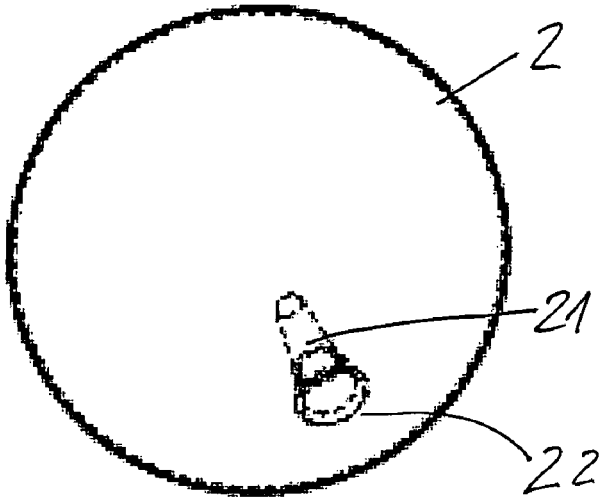
FIG. 2 shows an ammunition ball for the air gun.

An ammunition ball 2 is shown in FIG. 2. As already mentioned earlier, it is a thin-walled hollow plastic ball which may consist for example of polypropylene with a wall thickness of the ball walls of about 0.9 to 1 mm. The diameter is preferably about 70 mm, but it may be somewhat smaller or larger. At one location of its circumference, the hollow plastic ball has a recessed filler nozzle 21 via which the fill material can be filled into the ball, that is, particularly buckshot or small metal balls or other heavy granulated material such as sand, fine gravel mixed materials or similar. Then the filler nozzle 21 is closed by a plug which is not shown and the ammunition ball provided in this way is ready for use. When filled with buck shot, a hollow plastic ball with a diameter of 70 mm has a weight of, for example, 670 g.

The use of hard cast granular material with epoxy resin as a filler material for the hollow plastic ball has been found particularly advantageous for achieving very high penetration effects. The granular material comprises particles cast from hard metal preferably in the form of beads or pellets of a size of about 0.5 to 1.9 mm and a specific weight of about 7.3 kg/gm$^3$. These granules are mixed with an epoxy resin including an appropriate amount of hardener and then filled into the hollow plastic ball where the epoxy resin cures and becomes solid. Depending on the hardener used the epoxy resin solidifies more or less. With the use of such hard cast granulate material together with epoxy resin a form-stable and relatively hard ball is formed since the hard granular material in the ball form together with the cured epoxy resin as solid rigid body. With a diameter of about 70 mm such a ball has the same weight as a ball with a buckshot filling of about 670 g.

The epoxy resin-hard granulate filling however has an advantage over a buck shot filling or another filling material of loose material in that the ball obtained is hard and form-stable and, as a result, the gas pressure used for shooting the ball out of the cannon can be increased to about 40 bar. With such an increased pressure of 40 bar, the kinetic energy supplied to the ball during shooting is substantially increased so that also the impulse of the ball in the contact area of the target is increased. This is important since the qualities of the doors to be opened are very different. Often so-called multi-lock doors are used today, that is, entrance doors with several locks distributed over the circumference of the door. Because of the design of such doors and the extensive locking engagement structure with the door frame, these doors are difficult to open.

Still, it is of course necessary that the ammunition in the form of the filled plastic balls does not pose any danger to the user, particularly the projectile must not rebound but should spread upon impact on the door, that is it should plastically deform. Also this requirement is very well fulfilled by a ball with an epoxy resin-hard cast granulate material filling. On one hand, the epoxy resin hard granulate compound provides for a concentration of the impulse force of the ball in the impact direction on the respective door which much exceeds that of a ball with a loose granulate filling which readily explodes upon impact resulting in an outward dispersion of the granulate materials. On the other hand, upon impact and the breaking of the ball—in contrast to the hard cast granulate material, —the relatively soft epoxy resin material is plastically deformed but retains the particles so that the particles and the impact force are contained. As shown by experimental shots from a distance of about 40 cm onto a hard baffle plate, the ball breaks apart into relatively few large pieces without rebounding and without forming shrapnel so that the impact energy is transmitted to the largest possible extent to the door to be opened.

Figure 3:
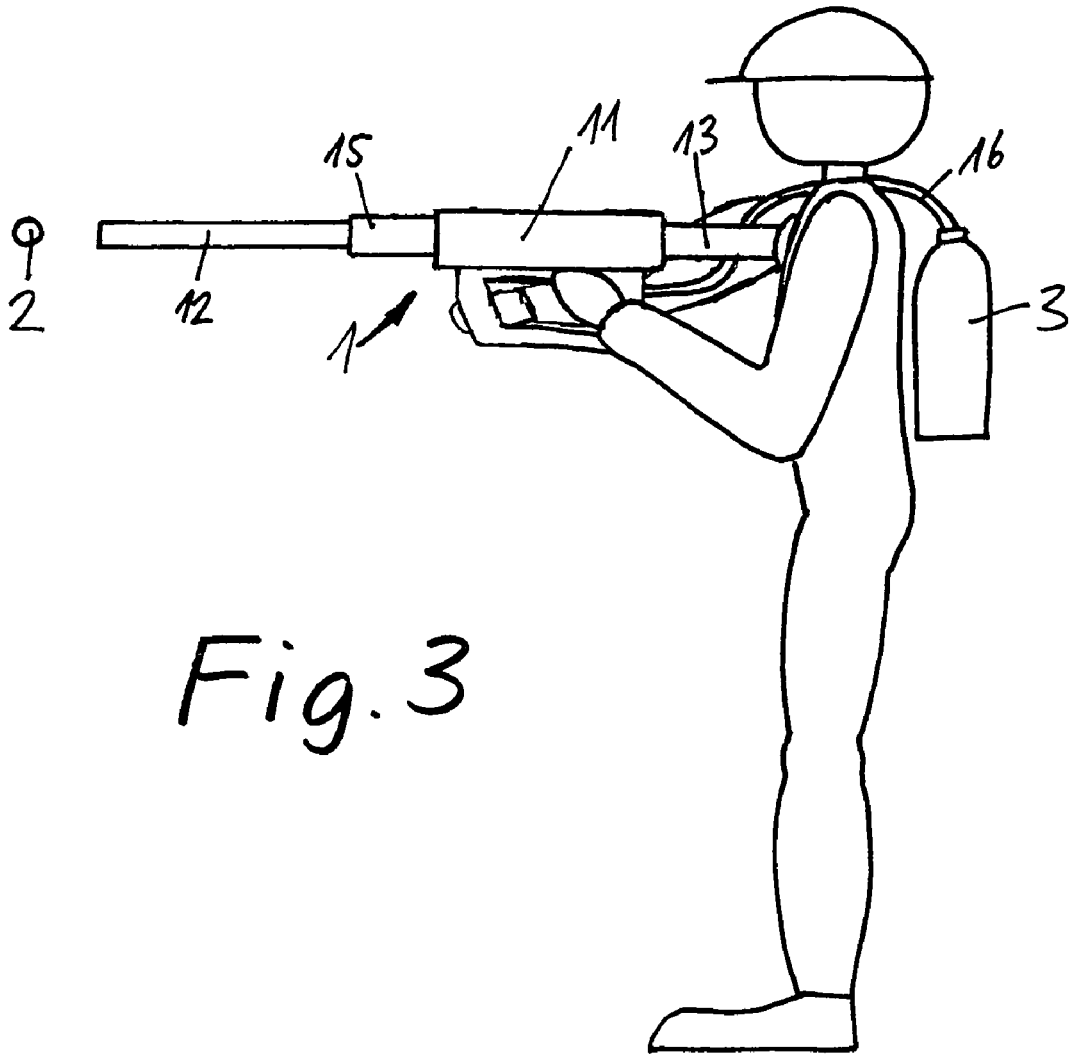
FIG. 3 shows the use of the air gun by a person.

FIG. 3 shows the apparatus according to the invention in use. The pressurized air cannon 1 with the pressure chamber 11 and the barrel 12 is held by a person shown schematically carrying a pressurized air battle 3 for charging the compressed air chamber 11 via the air pressure hose 16. The figure shows the deployment of the ammunition ball with the ammunition ball 2 leaving the barrel 12.

The pressurized air cannon can be operated with water-filled plastic balls or granulate-filled balls using air pressures of 10 to 30 bar, while pressures of 40 bars can be used for balls filled with an epoxy resin bonded hard granulate filling. The diameter of the ammunition balls, as mentioned earlier, may be about 70 mm or slightly less but it may also be larger up to about 90 mm.

The speed of the ammunition ball leaving the barrel is for water-filled balls or balls filled with loose granulate material, depending on the air pressure used, 80 to about 135 m/sec. For example, with a ball filled with buckshot and having a ball diameter of 70 mm and a ball weight of about 670 g with a ball speed of about 115 m/sec which is achieved by using an air pressure of 20 bar, the ball impacting on the door to be opened has a kinetic energy of about 4450 J and an impulse of about 115 J/cm$^2$.

The speed of the ammunition ball leaving the barrel using an epoxy resin bonded hard casting particle filling and an operating gas pressure of 30 bar is about 160 m/sec and the ammunition ball, upon impacting on the door to be opened, then has a kinetic energy of about 8600 J and an impulse of about 225 J/cm$^2$. Upon operation of the pressurized air cannon with an air pressure of 40 bar, the ball filled with the epoxy resin bonded hard granulates has, upon impacting the door to be opened, a kinetic energy of about 16200 J and an impulse of about 420 J/cm$^2$. As apparent therefrom with the use of an ammunition ball filled with epoxy resin bonded hard granulate material and an air pressure of 30 bar twice the kinetic energy of a buckshot filled plastic ball of the same size and mass can be achieved. Upon operation of the pressurized air cannon with a pressure of 40 bar, four times the kinetic energy of buckshot filled balls of the same weight and the same mass can be achieved.

The compressed air gun can be reloaded in a simple manner in maximally 8 sec. As a result, several doors can be opened, one of the other, within a short period of time.

What is claimed is:

1. A compressed air gun for use by police and firefighting forces for breaking open doors, comprising a compressed air cannon (1) including an ammunition ball (2), said compressed air cannon having a compressed air chamber (11), a barrel (12) extending from the compressed air chamber (11) and being provided at its rear end near the compressed air chamber (11) with an insert opening (17) for placing the ammunition bail (2) into the barrel (12), a closure sleeve (15) axially movably disposed on the barrel (12) for closing the insert opening (17), means (18) connected to the closure sleeve (15) for retaining the ammunition ball (2) in the barrel (12) at the end thereof adjacent the compressed air chamber (11) and a manually operable discharge valve (19) for releasing the compressed air from the compressed air chamber (11) into the barrel (12) for driving the ammunition ball (2) out of the barrel, said ammunition ball (2) consisting of a hollow plastic ball filled with a material.

2. A compressed air gun according to claim 1, wherein the ammunition ball (2) is filled with one of buckshot pellets and metal beads and the compressed air chamber includes compressed air at a pressure of 10 to 30 bar for shooting the ammunition ball out of the barrel (12).

3. A compressed air gun according to claim 1, wherein the hollow plastic ammunition ball (2) is filled with epoxy resin-bonded granulated cast metal material and the compressed air chamber includes compressed air at a pressure of 20 to 40 bar.

4. A compressed air gun according to claim 1, wherein the ammunition ball (2) has a diameter of 70–90 mm.

5. A compressed air gun according to claim 1, wherein the hollow plastic ball (2) has an inwardly recessed filler nozzle (21) which can be closed by a plug (22).

6. A compressed air gun according to claim 1, wherein the cannon ball (12) comprises a hollow plastic ball filled with water.

* * * * *